US008910481B2

(12) United States Patent
Kim et al.

(10) Patent No.: US 8,910,481 B2
(45) Date of Patent: Dec. 16, 2014

(54) ADVANCED QUENCH PATTERN COMBUSTOR

(75) Inventors: Won-Wook Kim, West Hartford, CT (US); Timothy S. Snyder, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 762 days.

(21) Appl. No.: 12/466,948

(22) Filed: May 15, 2009

(65) Prior Publication Data

US 2010/0287941 A1 Nov. 18, 2010

(51) Int. Cl.
*F23R 3/06* (2006.01)

(52) U.S. Cl.
CPC ..... *F23R 3/06* (2013.01)
USPC ..... 60/752; 60/804; 60/754; 60/732

(58) Field of Classification Search
CPC ..... F23R 3/06
USPC ..... 60/804, 752, 760, 754, 732
See application file for complete search history.

(56) References Cited

U.S. PATENT DOCUMENTS

| | | | | |
|---|---|---|---|---|
| 2,821,066 | A * | 1/1958 | Clarke et al. | 60/804 |
| 3,645,095 | A * | 2/1972 | Melconian | 60/804 |
| 5,256,352 | A | 10/1993 | Snyder et al. | |
| 5,461,865 | A | 10/1995 | Snyder et al. | |
| 5,479,773 | A | 1/1996 | McCoomb et al. | |
| 5,865,609 | A | 2/1999 | Sowa et al. | |
| 5,887,795 | A | 3/1999 | Sowa et al. | |
| 6,176,087 | B1 | 1/2001 | Snyder et al. | |
| 6,240,731 | B1 | 6/2001 | Hoke et al. | |
| 6,260,359 | B1 * | 7/2001 | Monty et al. | 60/752 |
| 6,513,329 | B1 | 2/2003 | Snyder et al. | |
| 6,606,861 | B2 | 8/2003 | Snyder | |
| 6,655,149 | B2 * | 12/2003 | Farmer et al. | 60/754 |
| 6,810,673 | B2 | 11/2004 | Snyder | |
| 7,007,864 | B2 | 3/2006 | Snyder et al. | |
| 7,363,763 | B2 | 4/2008 | Coughlan, III et al. | |
| 7,905,094 | B2 * | 3/2011 | Dudebout et al. | 60/752 |
| 7,942,006 | B2 * | 5/2011 | Critchley et al. | 60/754 |
| 2002/0116929 | A1 | 8/2002 | Snyder | |
| 2007/0125093 | A1 * | 6/2007 | Burd et al. | 60/804 |
| 2008/0010992 | A1 | 1/2008 | Patterson et al. | |
| 2008/0127651 | A1 * | 6/2008 | Zupanc et al. | 60/752 |
| 2008/0245075 | A1 | 10/2008 | Snyder | |
| 2008/0264064 | A1 * | 10/2008 | Sze et al. | 60/752 |
| 2009/0139239 | A1 * | 6/2009 | Zupanc et al. | 60/752 |
| 2009/0308077 | A1 * | 12/2009 | Shelley et al. | 60/752 |
| 2010/0077763 | A1 * | 4/2010 | Alkabie | 60/754 |

(Continued)

OTHER PUBLICATIONS

EP search report for EP10163039.0 dated Jul. 17, 2014.

* cited by examiner

*Primary Examiner* — Ted Kim
(74) *Attorney, Agent, or Firm* — O'Shea Getz P.C.

(57) ABSTRACT

A combustor for a gas turbine engine is provided. The combustor includes a forward bulkhead, an inner radial combustor wall, and an outer radial combustor wall. The bulkhead includes a plurality of circumferentially disposed injector apertures. The inner radial combustor wall includes a plurality of inner quench aperture sets. Each inner quench aperture set includes a first inner quench aperture and a second inner quench aperture separated from each other by an inner interset distance. Each inner quench aperture set is separated from an adjacent inner quench aperture set by an inner intraset distance. The inner intraset distance is different than the inner interset distance. The outer radial combustor wall includes a plurality of circumferentially disposed outer quench apertures. The outer radial combustor wall is disposed radially outside of the inner radial combustor wall, thereby defining an annular combustion region therebetween.

17 Claims, 5 Drawing Sheets

ADVANCED QUENCH PATTERN COMBUSTOR

BACKGROUND OF THE INVENTION

1. Technical Field

This disclosure relates generally to combustors for gas turbine engines and, more particularly, to the configuration of quench apertures in a combustor for a gas turbine engine.

2. Background Information

A typical combustor in a gas turbine engine has a combustion chamber having a forward section, an intermediate section (sometimes referred to as a "quench section") and an aft section. The combustion chamber includes a forward bulkhead, an inner annular wall and an outer annular wall which extend from the forward bulkhead to an exhaust outlet. The forward section of the combustion chamber includes a plurality of circumferentially disposed nozzles and swirlers. The intermediate section of the combustion chamber includes a plurality of equally spaced quench apertures circumferentially disposed in the inner and outer walls.

In operation, fuel from the nozzles is mixed with air from the swirlers and ignited by an ignition source in the forward section of the combustion chamber creating thermal hotspots circumferentially aligned with the nozzles. As known in the art, a thermal hotspot is a region in a thermal profile where the temperature is significantly elevated as compared to the surrounding area of the profile. The ignited fuel-air mixture flows from the forward section into the intermediate section where the mixture is quenched by additional air ("quench air") flowing into the chamber from the inner and the outer quench apertures. The quench air performs two functions: it provides oxygen for completion of combustion, and it is used to affect the shape of the thermal profile. The quenched mixture flows from the intermediate section, through the aft section, and out of the combustor through the combustor exit. However, the exhausted combusted mixture may still exhibit significant thermal hotspots which reduce the efficiency of the engine.

SUMMARY OF THE DISCLOSURE

According to an aspect of the present invention, a combustor for a gas turbine engine is provided. The combustor includes a forward bulkhead, an inner radial combustor wall, and an outer radial combustor wall. The bulkhead includes a plurality of circumferentially disposed injector apertures. The inner radial combustor wall is attached to, and extends axially out from, the forward bulkhead. The inner radial combustor wall includes a plurality of inner quench aperture sets. Each inner quench aperture set includes a first inner quench aperture and a second inner quench aperture separated from each other by an inner intraset distance. Each inner quench aperture set is separated from an adjacent inner quench aperture set by an inner interset distance. The inner interset distance is different than the inner intraset distance. The outer radial combustor wall is attached to and extends axially out from the forward bulkhead. The outer radial combustor wall includes a plurality of circumferentially disposed outer quench apertures. The outer radial combustor wall is disposed radially outside of the inner radial combustor wall, thereby defining an annular combustion region therebetween.

According to another aspect of the present invention, a combustor for a gas turbine engine is provided. The combustor includes a forward bulkhead, an inner radial combustor wall, and an outer radial combustor wall. The bulkhead includes a plurality of circumferentially disposed injector apertures. The inner radial combustor wall is attached to, and extends axially out from, the forward bulkhead. The inner radial combustor wall includes a plurality of circumferentially disposed inner quench apertures. The outer radial combustor wall is attached to, and extends axially out from the forward bulkhead. The outer radial combustor wall includes a plurality of outer quench aperture sets. Each outer quench aperture set includes a middle quench aperture disposed between a first outer quench aperture and a second outer quench aperture. The middle quench aperture is spaced equidistant from the first and second outer quench apertures within that set by an outer intraset distance. Each outer quench aperture set is separated from an adjacent outer quench aperture set by an outer interset distance. The outer interset distance is different than the outer intraset distance. The outer radial combustor wall is disposed radially outside of the inner radial combustor wall, thereby defining an annular combustion region therebetween.

DETAILED DESCRIPTION OF THE INVENTION

Figure 1:
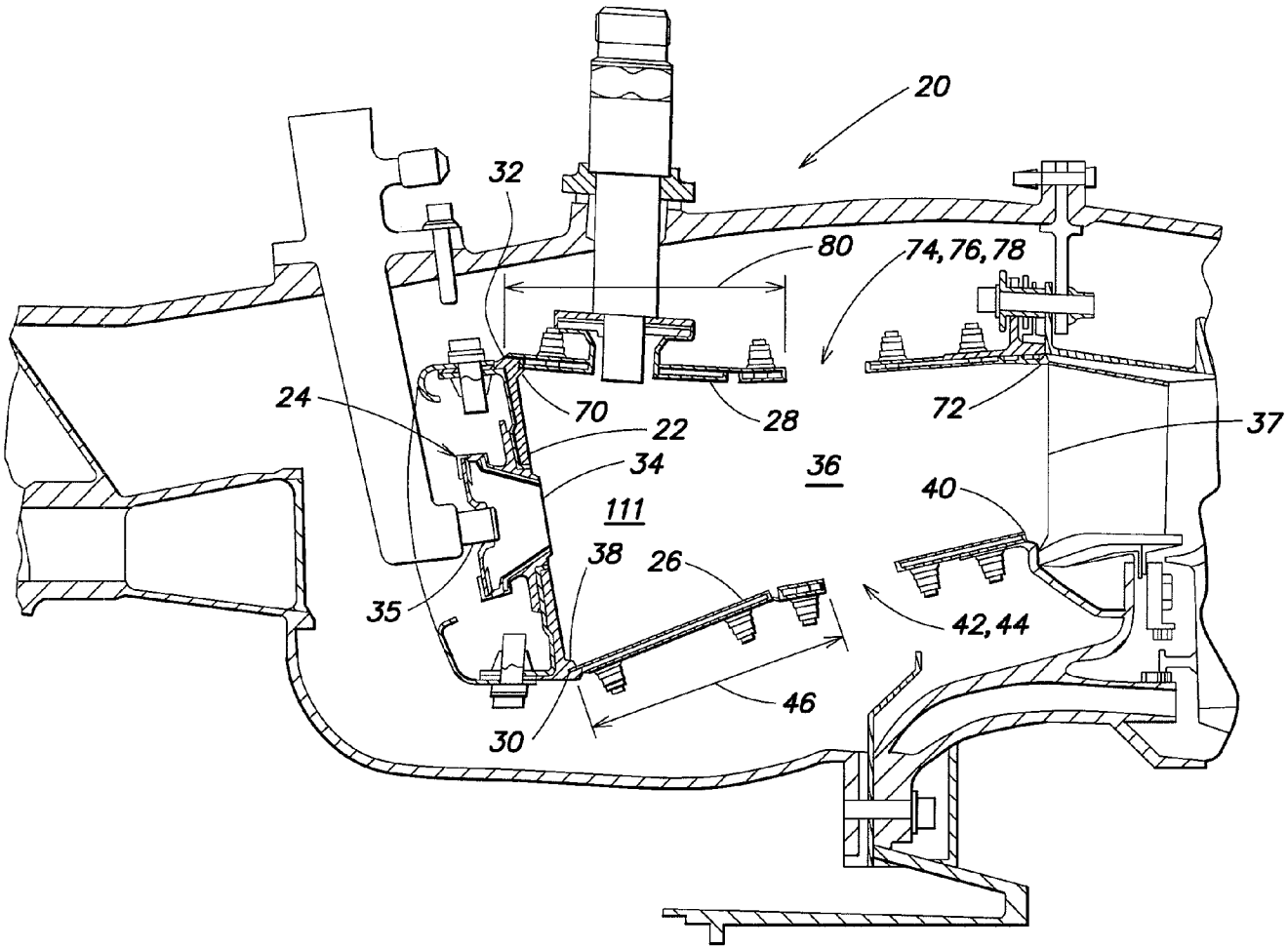
FIG. 1 is a diagrammatic illustration of one embodiment of a combustor.

FIG. 1 is a diagrammatic illustration of one embodiment of a combustor 20 for a gas turbine engine. The combustor 20 includes a forward bulkhead 22, a plurality of swirlers 24, an inner radial combustor wall 26, and an outer radial combustor wall 28.

The forward bulkhead 22 extends between an inner end 30 and an outer end 32, and includes a plurality of injector mounting apertures 34. The injector apertures 34 are configured in and typically uniformly spaced around the circumference of the forward bulkhead 22. Each injector aperture 34 is adapted to mount a swirler 24 operable to inject and swirl air for combustion into the combustor 20. Each swirler 24 includes a fuel nozzle 35. The inner radial combustor wall 26 is attached to the inner end 30 of the forward bulkhead 22, and the outer radial combustor wall 28 is attached to the outer end 32 of the forward bulkhead 22. The inner and outer walls 26, 28 define an annular combustion region 36 and a combustor outlet 37. As will be explained below, the fuel nozzles 35 may be aligned with or between quench apertures disposed within the combustor walls 26, 28.

The inner radial combustor wall 26 is an annular section extending between a first end 38 and a second end 40. The inner radial combustor wall 26 includes a plurality of circumferentially disposed inner quench apertures 42, 44 located at an axial distance 46 from the forward bulkhead 22. The inner quench apertures 42, 44 are configured for radially injecting a quantity of quench air for mixing and combusting with an axially traveling mixture of swirled air and fuel. Although it can vary by application, the quantity of quench air injected through the inner quench apertures 42, 44 is typically greater than the quantity of air injected through the air swirlers 24. In some embodiments, the inner radial combustor wall 26 further includes a plurality of circumferentially and axially disposed cooling apertures (not shown) configured to cool the inner radial combustor wall 26. As the name implies, these cooling apertures provide a different function than the quench apertures.

Figure 2:
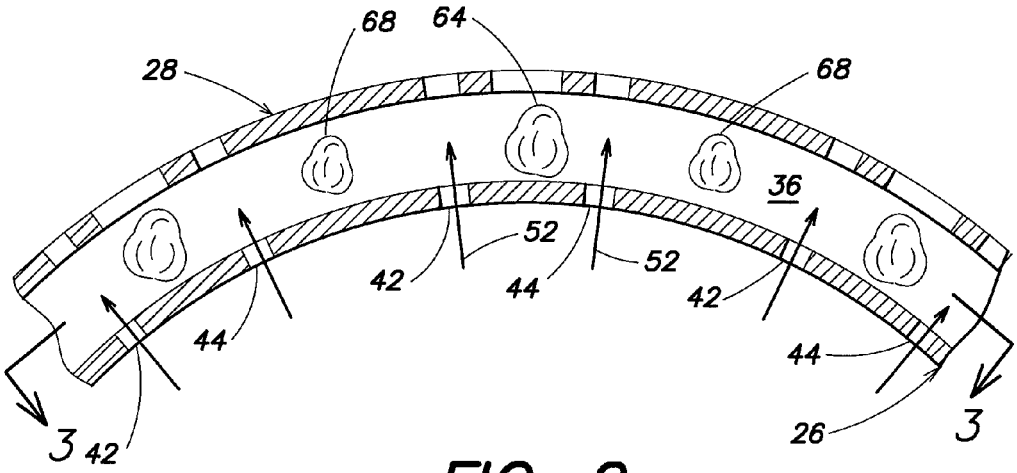
FIG. 2 is a diagrammatic illustration of axial and radial flows through a cross-section of a portion of the combustor in FIG. 1.
Figure 3:
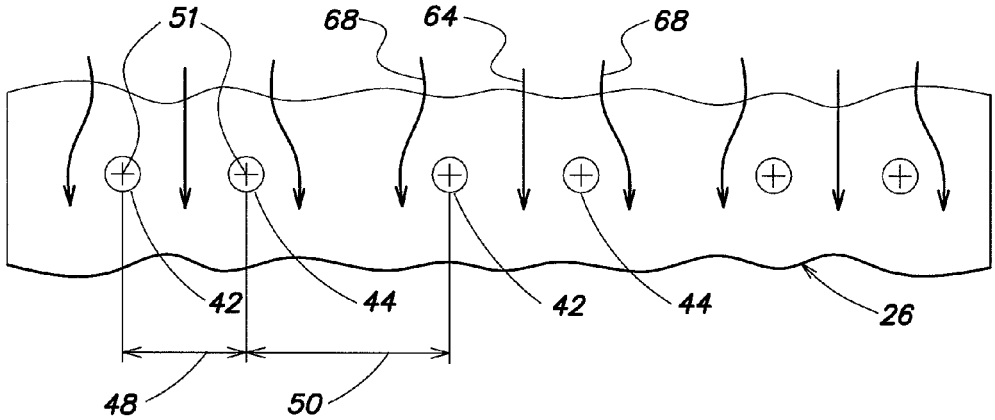
FIG. 3 is a diagrammatic illustration of the axial and the radial flows through a section of the portion of the combustor in FIG. 2.

In the embodiment in FIGS. 2 and 3, the inner quench apertures 42, 44 are disposed within the inner radial combustor wall 26 in a plurality of inner quench aperture sets. Each inner quench aperture set includes a first quench aperture 42 and a second quench aperture 44 separated from each other by an intraset distance 48. The intraset distance 48 is the distance between centers 51 of the quench apertures 42, 44 in a particular quench aperture set. Each quench aperture set is separated from an adjacent quench aperture set by an interset distance 50. The interset distance 50 is the distance between the centers 51 of adjacent quench apertures in different sets. The interset distance 50 may be equal to or greater than the intraset distance 48, depending upon the particular combustor embodiment. In the embodiment shown in FIGS. 2 and 3, the first and the second quench apertures 42, 44 have approximately equal diameters sized to inject a portion of the second quantity of air 52.

Figure 4:
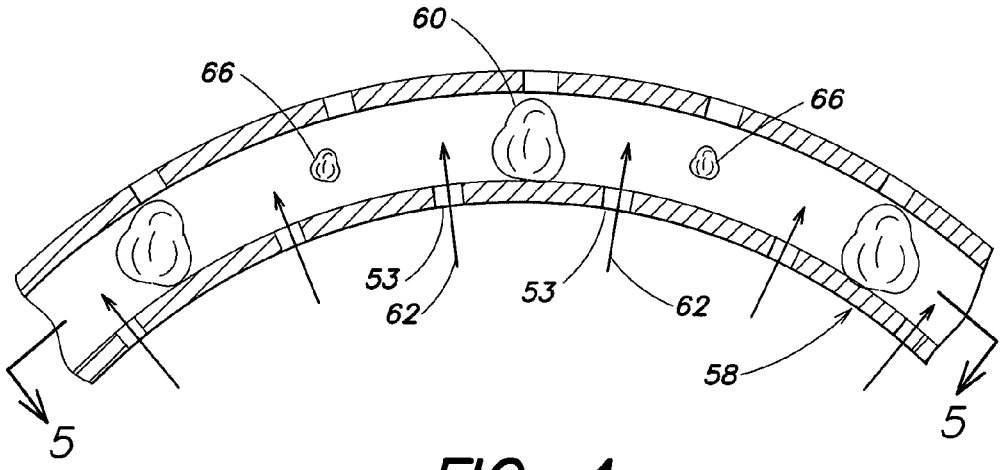
FIG. 4 is a diagrammatic illustration of axial and radial flows through a cross-section of a portion of a combustor.
Figure 5:
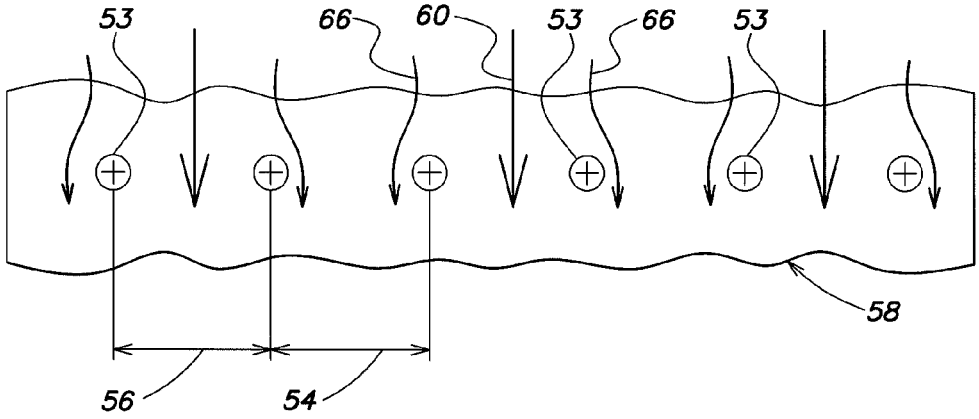
FIG. 5 is a diagrammatic illustration of the axial and the radial flows through a section of the portion of the combustor in FIG. 4.

The interset distance 50, the intraset distance 48 and/or the diameters of the quench apertures 42, 44 in the inner radial combustor wall 26 are selected to create radially extending flow patterns that influence the axial flow pattern of air, unburned fuel, and combustion products (hereinafter referred to as the "axial air") within the combustor 20. The axial flow pattern of the axially injected fuel is influenced by the impingement of the radially injected quench air. The ability to selectively influence the axial flow pattern is particularly desirable in applications where the air/fuel mix delivered from the nozzles 35 is localized in discrete positions around the circumference of the combustor, and therefore not distributed in a circumferentially uniform manner. FIGS. 2 and 3 diagrammatically show an inner radial combustor wall 26 having sets of quench apertures 42, 44 having an interset distance 50 that is greater than the intraset distance 48. FIGS. 4 and 5, in contrast, diagrammatically show an inner radial combustor wall 58 having uniformly spaced quench apertures 53 (i.e., interset distance 54 equals intraset distance 56). If the number of quench apertures disposed in the inner radial combustor walls 26, 58 is the same, the amount of axial air 60 flowing between the uniformly spaced radial quench air jets 62 (FIG. 4) is greater than the amount of axial air 64 that will flow between the radial quench air jets 52 associated with the shorter intraset distance 48. This is particularly so when flow from the nozzles 35 is locally concentrated at discrete circumferential positions which are aligned between the quench apertures 42, 44 and the quench apertures 5352. The axial air 66 traveling around the uniformly spaced radially quench air jets 62 (FIG. 5) is less than the amount of axial air 68 that will flow around the radial quench air jets 52 associated with the shorter intraset distance 48 (FIG. 3). As a result, the axial air flow pattern 64, 68 associated with the inner quench air aperture spacing shown in FIGS. 2 and 3 is more circumferentially uniform and mixed, than is the axial air flow pattern 60, 66 associated with the inner quench air aperture spacing shown in FIGS. 4 and 5.

The first and the second quench apertures 42, 44 may be sized to increase or decrease the impinging and/or dispersing effect on the axially injected fuel by increasing or decreasing the diameter of the first and the second quench apertures 42, 44. It should be noted that the aforesaid is an example of only one embodiment of the combustor 20 and the present invention is not limited to this particular embodiment.

Now referring to FIG. 1, the outer radial combustor wall 28 is an annular section extending between a first end 70 and a second end 72. The outer radial combustor wall 28 includes a plurality of circumferentially disposed outer quench apertures 74, 76, 78 located at an axial distance 80 from the first end 70 of the outer radial combustor wall 28. The outer quench apertures 74, 76, 78 are configured for radially injecting a quantity of quench air for mixing and combusting with the axially injected fuel. The quench air injected through the outer quench apertures 74, 76, 78 is typically greater than the axial air passing through the combustor 20. In some embodiments, the quantity of quench air injected through the outer quench apertures 74, 76, 78 is approximately equal to the quantity of quench air injected through the inner quench apertures 42, 44. In some embodiments, the outer radial combustor wall 28 includes a plurality of cooling apertures (not shown) configured to cool the combustor 20.

Figure 6:
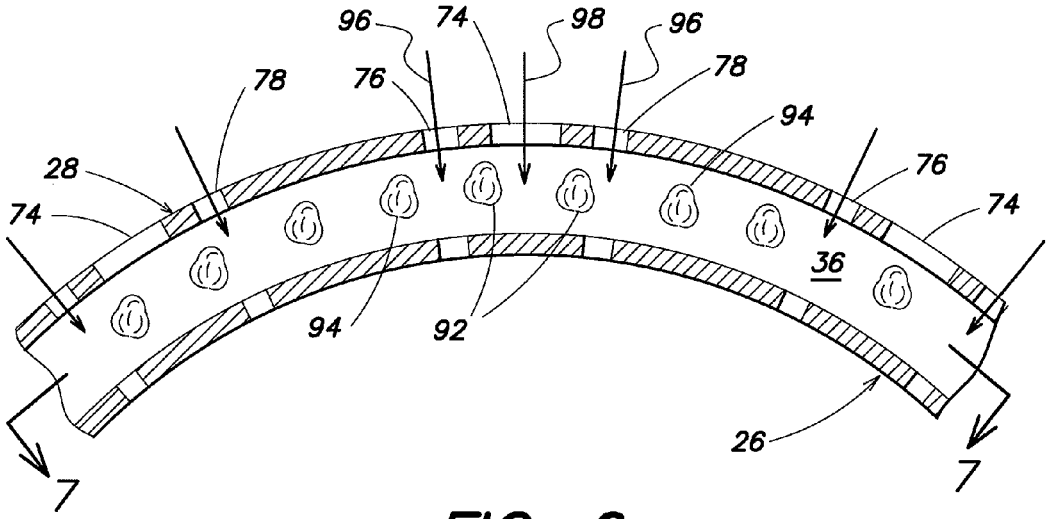
FIG. 6 is a diagrammatic illustration of axial and radial flows through a cross-section of a portion of the combustor in FIG. 1.
Figure 7:
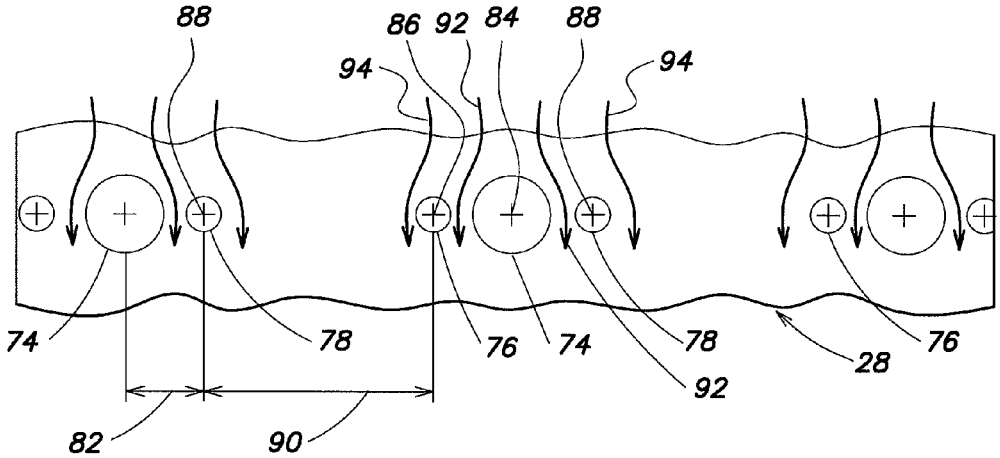
FIG. 7 is a diagrammatic illustration of the axial and the radial flows through a section of the portion of the combustor in FIG. 6.

In the embodiment shown in FIGS. 6 and 7, the outer quench apertures are disposed within the outer radial combustor wall 28 in a plurality of quench aperture sets. Each quench aperture set includes a middle quench aperture 74 disposed between a first quench aperture 76 and a second quench aperture 78. The middle quench aperture 74 is equidistant between the first quench aperture 76 and the second quench aperture 78. The intraset distance 82 is measured between the center 84 of the middle aperture 74 and the center 86, 88 of either the first or second aperture 76, 78. The interset distance 90 is the distance between the centers 86, 88 of adjacent quench apertures in different sets. The interset distance 90 may be equal to or different than the intraset distance 82.

In the embodiment shown in FIGS. 6 and 7, the first and the second quench apertures 76, 78 have approximately equal diameters, and the middle aperture 74 has a larger diameter than the first and second apertures 76, 78. The middle, first, and the second outer quench apertures 74, 76, 78 may be sized to increase or decrease the impinging and/or dispersing effect on the axially injected fuel by increasing or decreasing the diameter thereof. The diameters of the first and the second apertures 76, 78 in the outer radial combustor wall 28 may be equal to or smaller than the first and the second apertures 42, 44 in the inner radial combustor wall 26.

Figure 8:
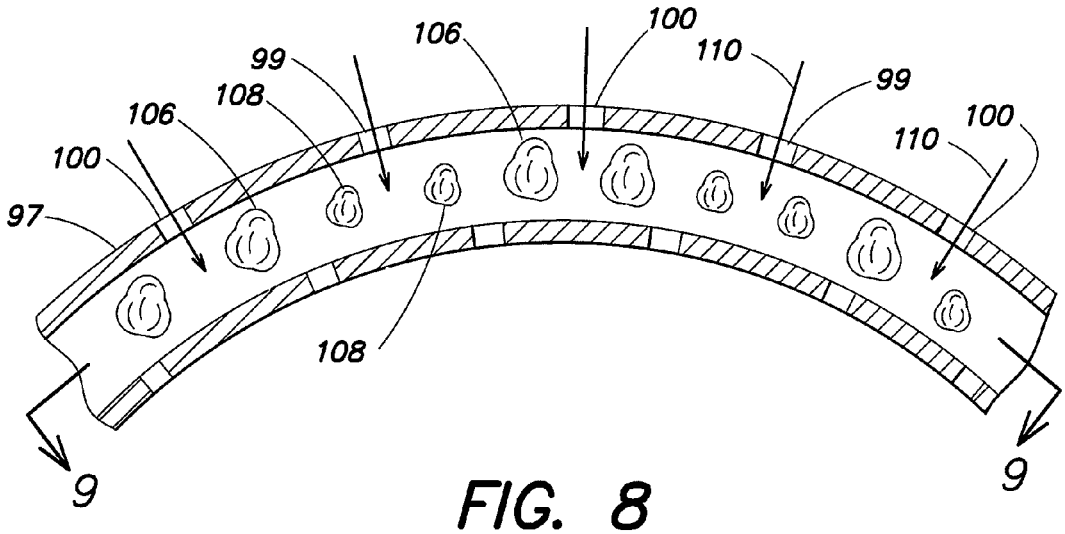
FIG. 8 is a diagrammatic illustration of axial and radial flows through a cross-section of a portion of a combustor.
Figure 9:
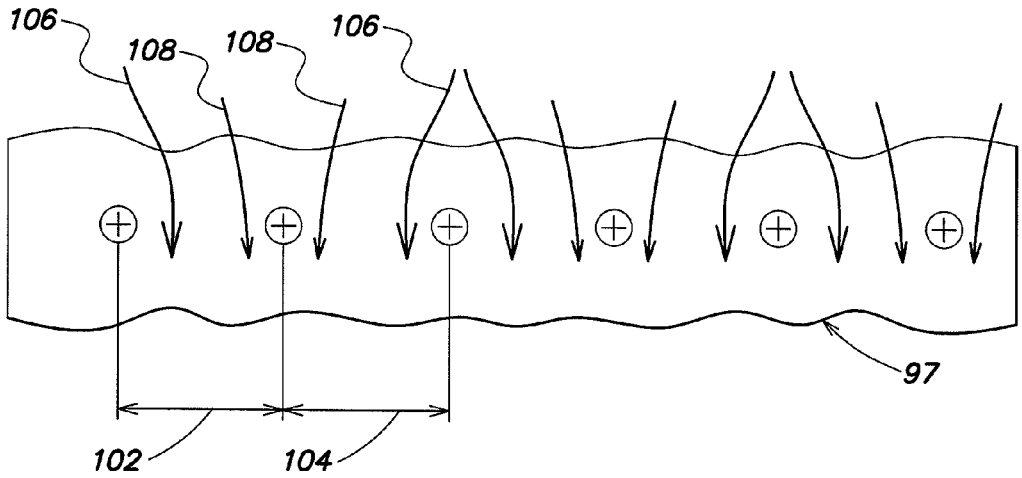
FIG. 9 is a diagrammatic illustration of the axial and the radial flows through a section of the portion of the combustor in FIG. 8.

The interset distance 90, the intraset distance 82 and/or the diameters of the quench apertures 74, 76, 78 in the outer radial combustor wall 28 are selected to create radially extending flow patterns that influence the axial flow within the combustor 20. The axial flow pattern of the axially injected fuel is influenced by the impingement of the radially injected outer quench air. For example, FIGS. 6 and 7 diagrammatically show an outer radial combustor wall 28 having sets of quench apertures 74, 76, 78 having an interset distance 90 that is greater than the intraset distance 82. This arrangement of intraset and interset distances 82, 90 promotes a circumferentially uniform and mixed axial air flow pattern 92, 94 by passing through and around the quench aperture jets 96, 98. This is particularly so when the flow from the nozzles 35 is locally concentrated at discrete circumferential positions which are aligned with the middle quench aperture 74. FIGS. 8 and 9, in contrast, diagrammatically show an outer radial combustor wall 97 having uniformly spaced quench apertures 99, 100 (i.e., interset distance 102 equal to the intraset distance 104). The axial flow pattern associated with an outer radial combustor wall 97 that includes uniformly spaced quench apertures 99, 100 is such that at least portions of the axial air flows 106, 108 between the outer radial quench air jets 110 will remain substantially unmixed.

As described above, the present invention combustor can include an inner radial combustor wall 26 with quench apertures 42, 44 disposed in sets that have an interset distance 50 that is equal to or greater than an intraset distance 48. The present invention combustor is also described as having an outer radial combustor wall 28 with quench apertures 74, 76, 78 disposed in sets that have an interset distance 90 that is equal to or greater than an intraset distance 82. The wall 26, 28 embodiments having quench aperture sets having unequal interset and intraset distances can be used with an opposing wall embodiment having uniformly spaced quench apertures, or an opposing wall embodiment also having quench aperture sets with unequal interset and intraset distances. For example, in some embodiments the outer radial combustor wall 28 has quench apertures having an interset distance 90 that is approximately equal to the intraset distance 82, and an inner combustor wall 26 has quench apertures having an interset distance 50 that is greater than the intraset distance 48. In another example, the outer radial combustor wall has quench apertures with an interset distance 90 that is greater than the intraset distance 82, and the inner radial combustor wall 26 has quench apertures with an interset distance 50 that is approximately equal to the intraset distance 48. The present invention is not limited to these examples.

In operation, each nozzle 35 in the forward bulkhead 22 injects a quantity of fuel into the combustion region of the combustor 20 in a substantially axial direction. It should be noted that a stoichiometric or higher quantity of air is needed to fully combust all the fuel axially injected from the nozzles. A first portion of the air necessary for combustion is injected into the combustion region from a front end region 111 (e.g., the swirlers 24) to provide a rich fuel-air mixture. The ignition source (not shown) initiates the combustion of the fuel-air mixture, creating thermal hotspots circumferentially aligned with the nozzles 35. As previously described, a thermal hotspot is a region in a thermal profile where the temperature is significantly elevated as compared to the surrounding area of the profile.

The partially combusted fuel-air mixture travels substantially axially through the combustion region 36 towards the inner and outer quench apertures. Additional quantities of air (i.e., "quench air") are radially injected into the combustion region from the inner and outer quench apertures. The quench apertures in one or both of the inner and outer radial combustor walls 26, 28 may be arranged such that the intraset distances 48, 82 are less than the interset distances 50, 90. The injected quench air impinges upon, and mixes with, the partially combusted fuel-air mixture as it travels between the inner and outer quench apertures. In the case where the quench apertures 42, 44 have a smaller intraset distance 48 than an interset distance 50, and the quench apertures are positioned such that the space between them is aligned with a nozzle 35, the radial jets 52 through the apertures 42, 44 promote more uniform circumferential distribution of the axial air as is diagrammatically shown in FIG. 3. Similarly, in the case where the middle apertures 74 of the outer wall 28 quench apertures are each aligned with a nozzle, the radial jet through the middle aperture 74 promotes more uniform circumferential distribution of the axial air as is diagrammatically shown in FIG. 7. The impinging air also affects the radial position of the partially combusted fuel-air mixture. The resulting axial air profile produces a more uniform thermal profile around the circumference of the combustor 20 with controlled radial positioning.

While various embodiments of the present invention have been disclosed, it will be apparent to those of ordinary skill in the art that many more embodiments and implementations are possible within the scope of the invention. Accordingly, the present invention is not to be restricted except in light of the attached claims and their equivalents.

What is claimed is:

1. A combustor for a gas turbine engine, comprising:

a forward bulkhead having a plurality of injector apertures circumferentially disposed around the forward bulkhead;

an inner radial combustor wall attached to and extending axially out from the forward bulkhead, which inner radial combustor wall includes a plurality of inner quench aperture sets, each inner quench aperture set including a first inner quench aperture and a second inner quench aperture separated from each other by an inner intraset distance, wherein each inner quench aperture set is separated from an adjacent inner quench aperture set by an inner interset distance, and wherein the inner interset distance is greater than the inner intraset distance;

an outer radial combustor wall attached to and extending axially out from the forward bulkhead, which outer wall includes a plurality of circumferentially disposed outer quench apertures; and a plurality of air swirlers, wherein each air swirler is mounted with a respective one of the injector apertures;

wherein the outer radial combustor wall is disposed radially outside the inner radial combustor wall defining an annular combustion region therebetween;

wherein a first quantity of quench air passing through the first inner quench apertures and the second inner quench apertures is greater than a second quantity of air passing through the air swirlers; and wherein each injector aperture is circumferentially aligned between the first inner quench aperture and the second inner quench aperture of a respective one of the plurality of inner quench aperture sets.

2. The combustor of claim 1, wherein each air swirler includes a nozzle, and each nozzle is located relative to one of the injector apertures in the forward bulkhead.

3. The combustor of claim 1, wherein the plurality of outer quench apertures is configured into a plurality of outer quench aperture sets, each outer quench aperture set including a middle outer quench aperture disposed between a first outer quench aperture and a second outer quench aperture, wherein the middle outer quench aperture is spaced equidistant from the first and the second outer quench apertures within that set by an outer intraset distance, wherein each outer quench aperture set is separated from an adjacent outer quench aperture set by an outer interset distance, and wherein the outer interset distance is different than the outer intraset distance.

4. The combustor of claim 3, wherein each middle outer quench aperture in the outer radial combustor wall has a first diameter, wherein each first and second outer quench aperture has a second diameter, and wherein the first diameter is greater than the second diameter.

5. The combustor of claim 4, wherein each first and second inner quench aperture in the inner radial combustor wall has a third diameter, and wherein the third diameter is equal to or smaller than the first diameter and equal to or greater than the second diameter.

6. The combustor of claim 3, wherein each middle outer quench aperture in the outer radial combustor wall has a first diameter, wherein each first and second outer quench aperture has a second diameter, and wherein the first diameter is approximately equal to the second diameter.

7. A combustor for a gas turbine engine, comprising:

a forward bulkhead having a plurality of injector apertures circumferentially disposed around the forward bulkhead;

an annular inner combustor wall extending axially between the forward bulkhead and a second end, which inner combustor wall includes a plurality of quench apertures sets, wherein each quench aperture set includes a first quench aperture and a second quench aperture separated from each other by an intraset distance, wherein each quench aperture set is separated from an adjacent quench aperture set by an interset distance that is greater than the intraset distance; and a plurality of air swirlers, wherein each air swirler is mounted with a respective one of the injector apertures;

wherein each injector aperture is circumferentially aligned between the first quench aperture and the second quench aperture of a respective one of the plurality of quench aperture sets; and wherein a first quantity of quench air passing through the first quench apertures and the second quench apertures is greater than a second quantity of air passing through the air swirlers.

8. The combustor of claim 7, wherein each air swirler includes a nozzle, and each nozzle is located relative to one of the injector apertures in the forward bulkhead.

9. The combustor of claim 7, further comprising an annular outer combustor wall extending axially between the forward bulkhead and a second end, which outer combustor wall radially surrounds the inner combustor wall, and which outer combustor wall includes a plurality of circumferentially disposed quench apertures.

10. A combustor for a gas turbine engine, comprising:

a forward bulkhead having a plurality of injector apertures circumferentially disposed around the forward bulkhead;

an annular inner combustor wall extending axially between the forward bulkhead and a second end, the inner combustor wall including a plurality of quench apertures sets, wherein each quench aperture set includes a first quench aperture and a second quench aperture that are separated from one another by an intraset distance, wherein each quench aperture set is separated from an adjacent quench aperture set by an interset distance that is greater than the intraset distance; and a plurality of air swirlers, wherein each air swirler is mounted with a respective one of the injector apertures;

wherein each injector aperture is circumferentially aligned between the first quench aperture and the second quench aperture of a respective one of the plurality of quench aperture sets.

11. The combustor of claim 10, wherein a first quantity of quench air passing through the first and the second quench apertures is greater than a second quantity of air passing through the air swirlers.

12. The combustor of claim 10, wherein each air swirler includes a nozzle, and each nozzle is located relative to a respective one of the injector apertures in the forward bulkhead.

13. The combustor of claim 10, further comprising an annular outer combustor wall extending axially between the forward bulkhead and a second end, wherein the outer combustor wall radially surrounds the inner combustor wall, and the outer combustor wall includes a plurality of circumferentially disposed outer quench apertures.

14. The combustor of claim 13, wherein the plurality of outer quench apertures are configured into a plurality of outer quench aperture sets;

each outer quench aperture set includes a middle outer quench aperture disposed between a first outer quench aperture and a second outer quench aperture;

the middle outer quench aperture is spaced equidistant from the first and the second outer quench apertures within a respective set by an outer intraset distance; and each outer quench aperture set is separated from an adjacent outer quench aperture set by an outer interset distance that is different than the outer intraset distance.

15. The combustor of claim 14, wherein each middle outer quench aperture has a first diameter, each of the first and the second outer quench apertures has a second diameter, and the first diameter is greater than the second diameter.

16. The combustor of claim 15, wherein each of the first and the second quench apertures in the inner combustor wall has a third diameter, and the third diameter is one of equal to and smaller than the first diameter and one of equal to and greater than the second diameter.

17. The combustor of claim 14, wherein each middle outer quench aperture has a first diameter, each of the first and the second outer quench apertures has a second diameter, and the first diameter is approximately equal to the second diameter.

* * * * *